US006565018B1

(12) United States Patent
Degeyter

(10) Patent No.: US 6,565,018 B1
(45) Date of Patent: May 20, 2003

(54) SHOWER FLOW CONTROL DEVICE

(76) Inventor: John D. Degeyter, 237 N. College Rd., Lafayette, LA (US) 70506

( * ) Notice: Subject to any disclaimer, the term of this patent is extended or adjusted under 35 U.S.C. 154(b) by 0 days.

(21) Appl. No.: 09/779,995

(22) Filed: Feb. 9, 2001

(51) Int. Cl.[7] ..... B05B 1/30
(52) U.S. Cl. ..... 239/581.1; 239/581.2; 239/582.1; 239/569
(58) Field of Search ..... 239/581.1, 581.2, 239/582.1, 569; 137/625.41, 636.2, 454.6, 556, 801, 556.3, 556.6; 251/285, 286, 288; 116/277

(56) References Cited

U.S. PATENT DOCUMENTS

| | | | | | |
|---|---|---|---|---|---|
| 477,720 | A | * | 6/1892 | Weber | 137/556 |
| 2,981,284 | A | * | 4/1961 | Putnam | 137/556 |
| 4,191,332 | A | * | 3/1980 | DeLangis et al. | 239/428.5 |
| 4,497,444 | A | * | 2/1985 | Arnold | 239/587 |
| 5,188,335 | A | * | 2/1993 | Pettinaroli | 251/95 |
| 5,220,914 | A | * | 6/1993 | Thompson | 128/66 |
| 5,533,549 | A | * | 7/1996 | Sherman | 137/557 |
| 5,740,836 | A | * | 4/1998 | Tang | 137/625.41 |

OTHER PUBLICATIONS

Superior Specialty Company, Legend Valve Ball Valves brochure.*

Package label featuring "Shower Flow Control". Manufactured in Taiwan for ACE Hardware Corp. Oak Brook, IL. Copyright date 1996.

* cited by examiner

*Primary Examiner*—Michael Mar
*Assistant Examiner*—Davis Hwu

(57) ABSTRACT

A shower flow control device for quickly shutting off the flow of water through a shower head. The shower flow control device includes a tubular member having open ends and a bore extending therethrough with the tubular member being adapted to attach to a shower head and to a shower pipe; and also includes a valve member movably disposed in the bore of said tubular member and being adapted to open and close the bore; and further includes a lever being connected to the valve member and being adapted to move the valve member.

1 Claim, 3 Drawing Sheets

SHOWER FLOW CONTROL DEVICE

BACKGROUND OF THE INVENTION

1. Field of the Invention

The present invention relates to a water control device for a shower and more particularly pertains to a new shower flow control device for quickly shutting off the flow of water through a shower head.

2. Description of the Prior Art

The use of a water control device for a shower is known in the prior art. More specifically, a water control device for a shower heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,398,668; U.S. Pat. No. 4,394,969; U.S. Pat. No. 4,273,289; U.S. Pat. No. 4,484,711; U.S. Pat. No. 3,547,353; and U.S. Pat. No. Des. 287,995.

While these devices fulfill their respective, particular objectives and requirements the aforementioned patents do not disclose a new shower flow control device. The inventive device includes a tubular member having open ends and a bore extending therethrough with the tubular member being adapted to attach to a shower head and to a shower pipe; and also includes a valve member movably disposed in the bore of said tubular member and being adapted to open and close the bore; and further includes a lever being connected to the valve member and being adapted to move the valve member.

In these respects, the shower flow control device according to the present invention substantially departs from the conventional concepts and designs of the prior art, and in so doing provides an apparatus primarily developed for the purpose of quickly shutting off the flow of water through a shower head.

SUMMARY OF THE INVENTION

In view of the foregoing disadvantages inherent in the known types of water control device for a shower now present in the prior art, the present invention provides a new shower flow control device construction wherein the same can be utilized for quickly shutting off the flow of water through a shower head.

The general purpose of the present invention, which will be described subsequently in greater detail, is to provide a new shower flow control device which has many of the advantages of the water control device for a shower mentioned heretofore and many novel features that result in a new shower flow control device which is not anticipated, rendered obvious, suggested, or even implied by any of the prior art water control device for a shower, either alone or in any combination thereof.

To attain this, the present invention generally comprises a tubular member having open ends and a bore extending therethrough with the tubular member being adapted to attach to a shower head and to a shower pipe; and also includes a valve member movably disposed in the bore of said tubular member and being adapted to open and close the bore; and further includes a lever being connected to the valve member and being adapted to move the valve member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shower flow control device which has many of the advantages of the water control device for a shower mentioned heretofore and many novel features that result in a new shower flow control device which is not anticipated, rendered obvious, suggested, or even implied by any of the prior art water control device for a shower, either alone or in any combination thereof.

It is another object of the present invention to provide a new shower flow control device which may be easily and efficiently manufactured and marketed.

It is a further object of the present invention to provide a new shower flow control device which is of a durable and reliable construction.

An even further object of the present invention is to provide a new shower flow control device which is susceptible of a low cost of manufacture with regard to both materials and labor, and which accordingly is then susceptible of low prices of sale to the consuming public, thereby making such shower flow control device economically available to the buying public.

Still yet another object of the present invention is to provide a new shower flow control device which provides in the apparatuses and methods of the prior art some of the advantages thereof, while simultaneously overcoming some of the disadvantages normally associated therewith.

Still another object of the present invention is to provide a new shower flow control device for quickly shutting off the flow of water through a shower head.

Yet another object of the present invention is to provide a new shower flow control device which includes a tubular member having open ends and a bore extending therethrough with the tubular member being adapted to attach to a shower head and to a shower pipe; and also includes a valve member movably disposed in the bore of said tubular member and being adapted to open and close the bore; and further includes a lever being connected to the valve member and being adapted to move the valve member.

Still yet another object of the present invention is to provide a new shower flow control device that is easy and convenient to attach to a standard shower pipe and to a standard shower head.

Even still another object of the present invention is to provide a new shower flow control device that allows the user to quickly turn on and turn off the flow of water without having to adjust the temperature control valves.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
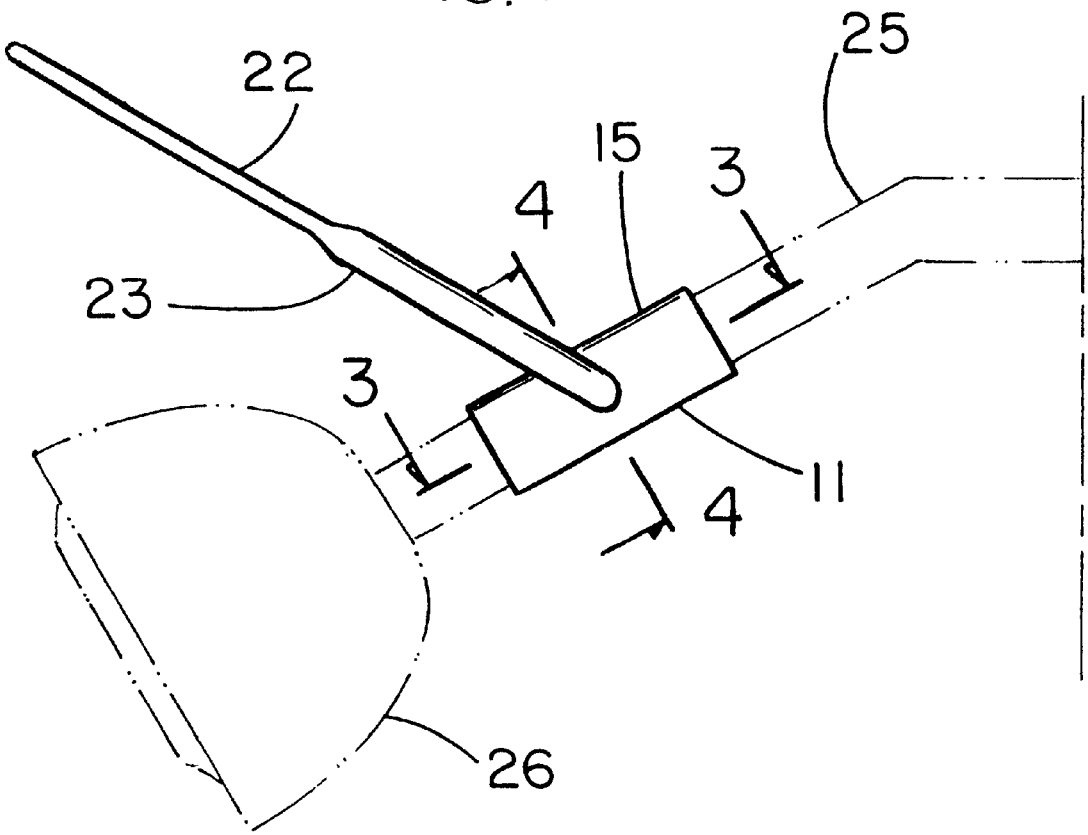
FIG. 1 is a side elevational view of a new shower flow control device according to the present invention and shown in use.
Figure 2:
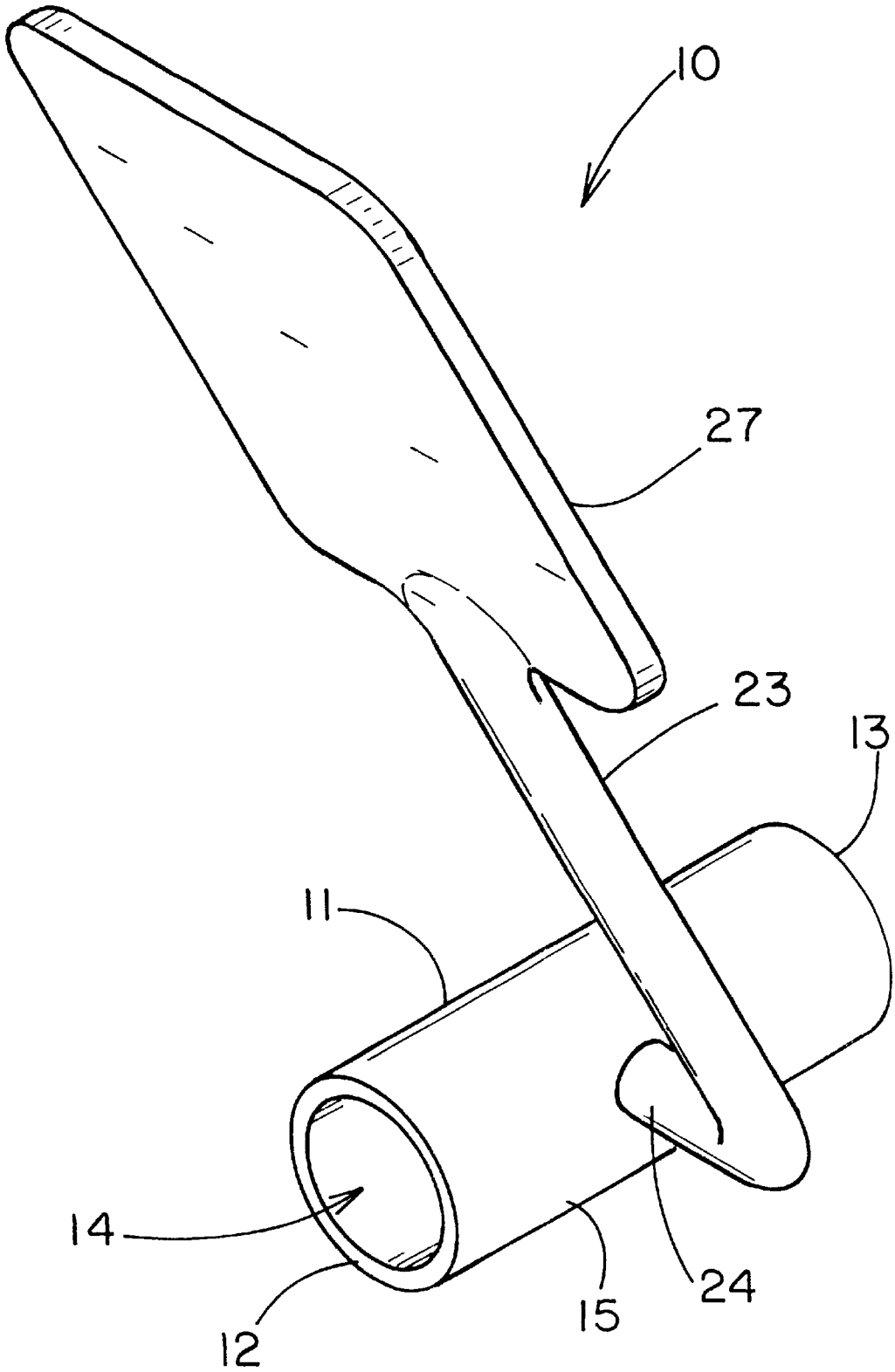
FIG. 2 is a perspective view of the present invention.
Figure 3:
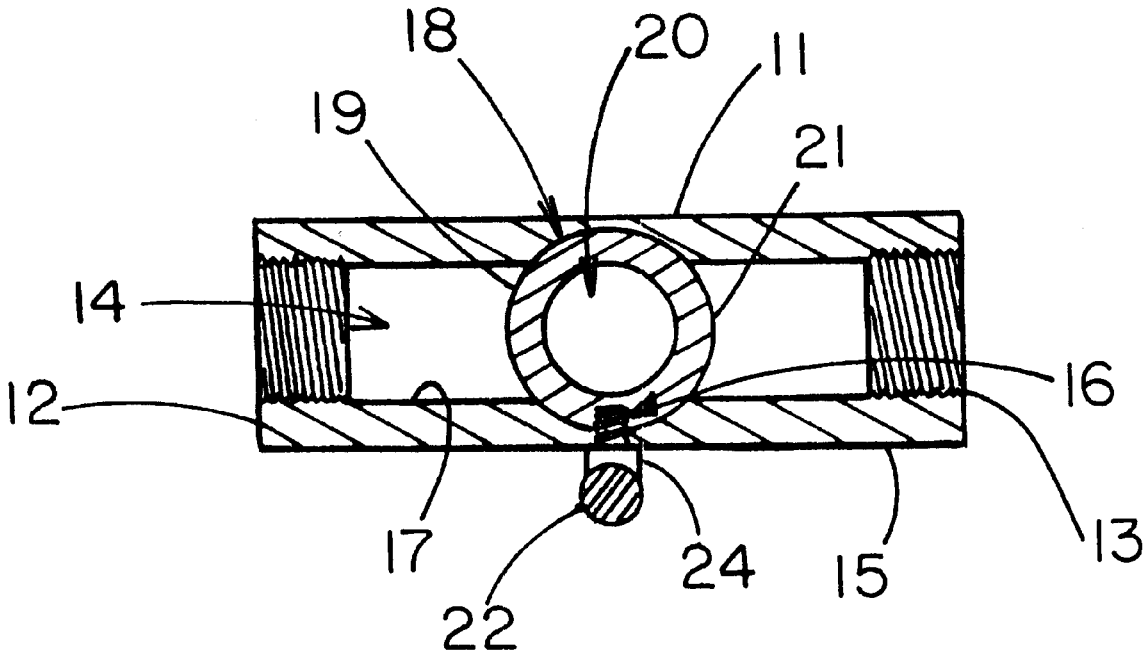
FIG. 3 is a longitudinal cross-sectional view of the present invention.
Figure 4:
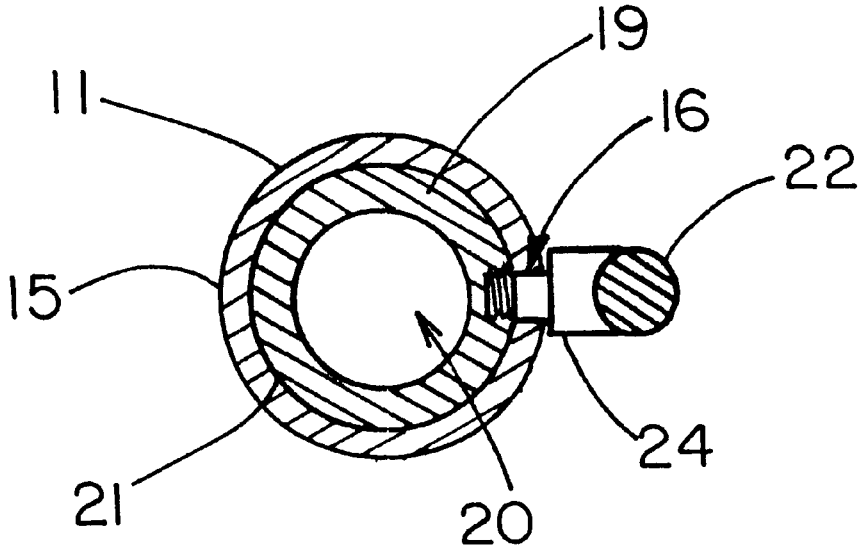
FIG. 4 is a lateral cross-sectional view of the present invention.

With reference now to the drawings, and in particular to FIGS. 1 through 4 thereof, a new shower flow control device embodying the principles and concepts of the present invention and generally designated by the reference numeral 10 will be described.

As best illustrated in FIGS. 1 through 4, the shower flow control, device 10 generally comprises a tubular member 11 having open ends 12, 13 and a bore 14 extending therethrough. The tubular member 11 is adapted to conventionally attach to a shower head 26 and to a water supply pipe 25. The tubular member 11 has a hole 16 disposed through a side wall 15 thereof and into the bore 14. The bore 14 includes a wall 17 defining the bore 14 and being threaded at end portions thereof and being adapted to threadingly receive the shower head 26 and the water supply pipe 25. The tubular member 11 also has an annular groove 18 extending in the wall 17 defining the bore 14.

A valve member 19 is movably disposed in the bore 14 of the tubular member 11 and is adapted to open and close the bore 14. The valve member 19 has a bore 20 extending therethrough and is rotatably disposed in the bore 14 and seated in the annular groove 18 of the tubular member 11. A lever 22 is conventionally connected to the valve member 19 and is adapted to move the valve member 19. The lever 22 has a main portion 23, a paddle-like handle portion 27, and an end portion 24 which is angled relative to the main portion 23 and which is disposed through the hole 16 of the tubular member 11 and which is threaded in a side wall 21 of the valve member 19 for pivoting the valve member 19 to open and close the bore 14 of the tubular member 11.

In use, the user pivots the lever 23 to either open or close the bore 14 of the tubular member 11 to either shut off the water being supplied by the water supply pipe 25 or to allow the water to flow from the water supply pipe 25 through the shower head 26.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shower flow control device comprising:

a tubular member having open ends and a bore extending therethrough, said tubular member being adapted to attach to a shower head and to a water supply pipe, said tubular member having a hole disposed through a side wall thereof and into said bore, said bore including a wall defining said bore and being threaded at end portions thereof and being adapted to threadingly receive the shower head and the water supply pipe, said tubular member also having an annular groove extending in said wall defining said bore;

a valve member movably disposed in said bore of said tubular member and having an open position and a closed position to open and close said bore, said valve member having a bore extending therethrough and being rotatably disposed in said bore and seated in said annular groove of said tubular member;

a lever being connected to said valve member and being adapted to move said valve member while said tubular member remains in a static position relative to the shower head and the water supply line whereby a direction of spray of the shower head remains constant when said lever is moved, said lever comprising a main portion, a paddle-like handle portion, and an end portion;

said handle portion having an open indicating position corresponding to said open position of said valve member, and a closed indicating position corresponding to said closed position of said valve member;

said handle portion being oriented substantially perpendicular to a longitudinal axis of said tubular member when said valve member is in said closed position and being oriented substantially parallel to said longitudinal axis when said valve member is in said open position for providing a tactile indication of the position of said valve member; and said handle portion of said lever comprising a plate having a larger cross sectional area than a cross sectional area of said main portion for facilitating locating of said lever by the hand of the user without looking at said lever while showering.

* * * * *